US005135418A

United States Patent [19]

Hatagishi et al.

[11] Patent Number: 5,135,418

[45] Date of Patent: Aug. 4, 1992

[54] ELECTRICAL SOCKET CONTACT

[75] Inventors: Yuji Hatagishi; Masayuki Yamamoto, both of Shizuoka, Japan

[73] Assignee: Yazaki Corporation, Tokyo, Japan

[21] Appl. No.: 669,993

[22] Filed: Mar. 15, 1991

[30] Foreign Application Priority Data

Mar. 20, 1990 [JP] Japan ..... 2-27689[U]

[51] Int. Cl.[5] ..... H01R 11/22

[52] U.S. Cl. ..... 439/857; 439/851

[58] Field of Search ..... 439/842, 843, 851-857, 439/861, 862

[56] References Cited

U.S. PATENT DOCUMENTS 4,168,878 9/1978 Risser et al. .

4,734,064 3/1988 Knapp et al. .

FOREIGN PATENT DOCUMENTS 1263085 4/1961 France ..... 439/851

89/05531 6/1989 PCT Int'l Appl. ..... 439/851

*Primary Examiner*—David L. Pirlot

*Attorney, Agent, or Firm*—Venable, Baetjer, Howard & Civiletti

[57] ABSTRACT

An electrical socket contact for receiving a pin contact comprises an electrical socket contact portion which includes a pair of spring tines having free ends, extending as cantilevers from a body thereof and opposite to each other. Flat contact portions having respectively a converging contact point which projects inward are formed at the free ends of the spring tines. Since a pair of the spring tines are formed so that two lines linking the converging contact points opposite to each other with respect to sections thereof are substantially orthogonal, it is possible to precisely and easily measure the distances between the contact points of the spring tines to define an opening for receiving the pin contact.

1 Claim, 2 Drawing Sheets

ELECTRICAL SOCKET CONTACT

BACKGROUND OF THE INVENTION

1. Field of the Invention

The present invention relates to a socket contact used to connect electric wires, and more particularly to a socket ontac used to connect wiring harnesses for an automobile.

2. Description of the Prior Art

This kind of conventional socket contact is disclosed in U.S. Pat. No. 4,734,064 "Electrical Socket Contact with Convex Engaging Tines" (issued on Mar. 29, 1988 to Knapp et al.). The socket contact is comprised of an electrical socket contact portion and an electric wire connecting portion. The electrical socket contact portion includes three spring tines separated by slits in a forward portion of a body, thereby defining an opening for receiving a pin contact inside thereof. In order to achieve a reliable contact of such socket and pin contacts, it is important to precisely control the distances between the three spring tines which define the above-mentioned opening. However, since the distances between the spring tines which respectively curve inwardly with respect to the body correspond to the lengths of three sides of a triangle linking the contact-points of the three spring tines with the pin contact, it is difficult to precisely measure the three distances.

SUMMARY OF THE INVENTION

It is an object of the present invention to provide an electrical socket contact in which an opening with precise dimensions can be easily formed among spring tines opposite to each other and the precision of dimension measurement of the opening can be enhanced when the socket contact is produced.

In order to achieve such an object, the present invention provides an electrical socket contact for receiving a pin contact, which is made of an electrioally conductive material, and has an electric wire connecting portion in the rear of a oylindrical body thereof and an electrioal sooket contact portion in the front of the body. The electrical socket contact portion comprises a pair of spring tines which have free ends, are separated by a longitudinal slit, and extend as cantilevers from the body so as to be brought into contact with the pin contact. The free end of each spring tine is configured to undergo a transition from an arcuate cross-section into a flat cross-section from the center to both ends thereof so as to form a pair of flat contact portions. Both flat contact portions have respectively a converging contact point which projects inwardly, and which are disposed perpendicularly to each other in the sectional view thereof. A pair of the spring tines are formed so that two lines linking the converging contact points of the flat ontact portions thereof are substantially orthogonal.

In a socket contact thus constructed, it is easy to precisely measure the distance between a pair of the spring tines which define an opening for receiving a pin contact. Therefore, the production quality control of the socket contact can be improved.

The above and other objects, features and advantages of the present invention will be apparent from the following description of preferred embodiments of the invention with reference to the accompanying drawings.

DETAILED DESCRIPTION OF THE PREFERRED EMBODIMENTS

Figure 1:
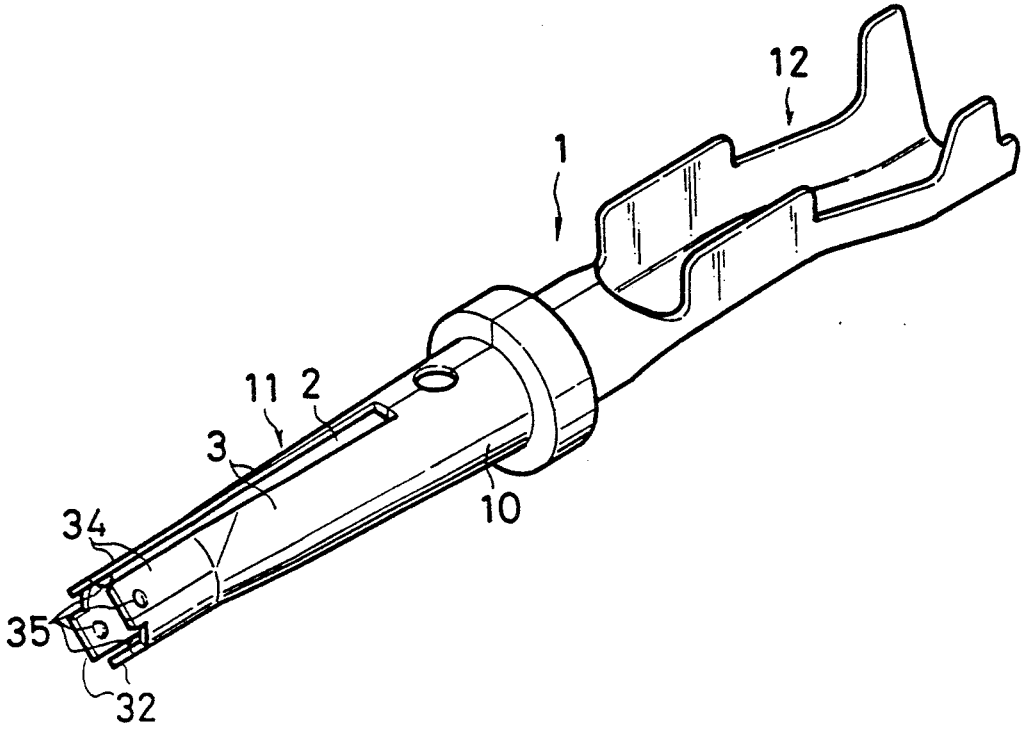
FIG. 1 is a perspective view of a socket oontact according to the present invention.
Figure 2:
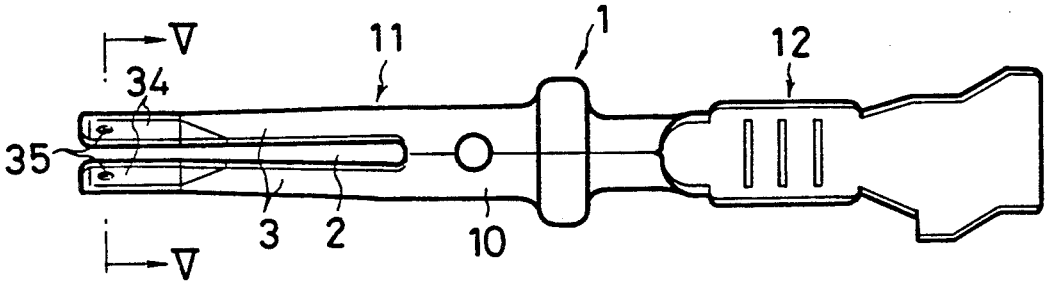
FIG. 2 is a plan view of the socket contact.
Figure 3:
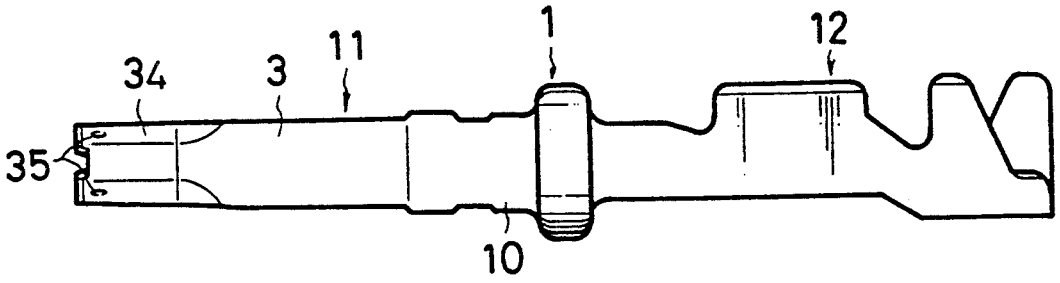
FIG. 3 is a side view of the socket contact.
Figure 4:
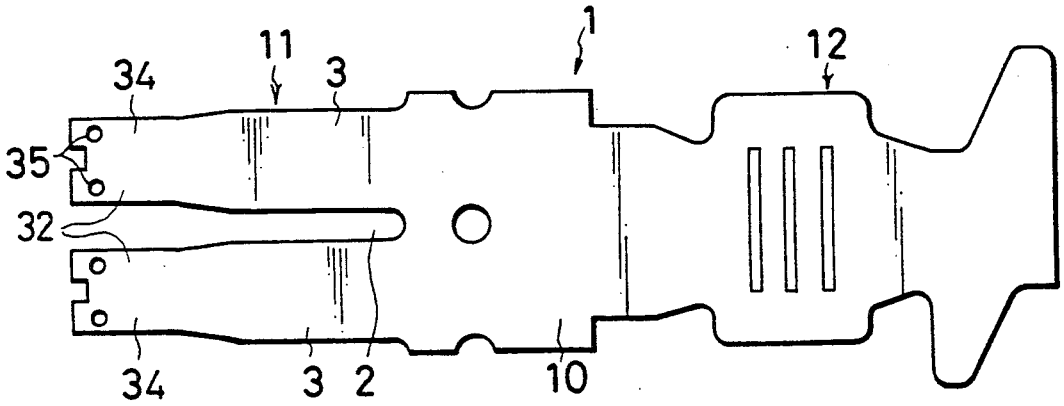
FIG. 4 is a stamped sheet of metal of the socket contact.
Figure 5:
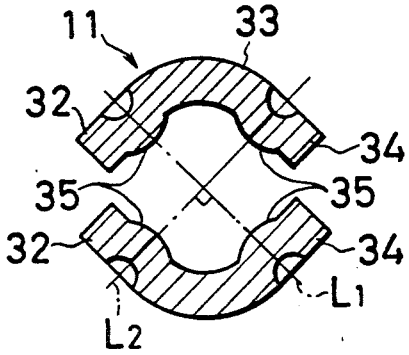
FIG. 5 is a sectional view taken on line V—V of FIG. 2.

As shown in FIGS. 1 to 5, a socket contact 1 of the present invention is composed of a body 10, an electrical socket contact portion 11, and an electric wire connecting portion 12, and formed by being stamped out from a sheet of electrically conductive metal and folded. The electrical socket contact portion 11 has a pair of spring tines 3 which extend as cantilevers in a forward portion of the cylindrical body 10 and are separated by a slit 2. Free ends of the spring tines 3 are arranged, as shown in a sectional view of FIG. 5, so that flat contact portions 32 and 34 disposed at both circumferential ends of the spring tine 3 are perpendicular to each other through a medial arcuate portion 33. Indented converging contact points 35 which pr ject inwardly are formed on the inside surfaces of the flat contact portions 32 and 34. The flat contact portion 32 of one of the spring tines 3 is opposite to the flat contact portion 34 of the other spring tine 3, and two imaginary lines $L_1$ and $L_2$, linking the converging contact points 35 on the inside surfaces of the two flat contact portions 32 and 34 which are opposite to each other, are substantially perpendicular to each other. Therefore, it is easy to precisely measure the distance between a pair of the spring tines 3 of the socket contact 1 which defines the space for receiving a pin contact, that is, the distance between the converging contact points 35 and 35 opposite to each other. It is therefore possible to enhance the production quality with respect to the dimensional precision of a receiving opening of the electrical socket contact portion 11 of the socket contact 1 and to uniformly maintain the quality of the products.

What is claimed is:

1. An electrical socket contact for receiving a pin contact comprising:

a cylindrical body formed from an electrically conductive material;

an electric wire connecting portion extending rearwardly of said body; and an electrical socket contact portion extending forwardly of said body, said socket contact portion comprising a pair of spring tines which are separated by a longitudinal slit and which extend as cantilevers from said body, each spring tine being substantially continuous over the entire area of the tine and having a substantially continuous arcuate transverse cross-section except at a free end of the tine, said free end having a pair of substantially flat contact portions and an arcuate portion disposed therebetween, so that said flat contact portions readily define a precisely spaced opening for receiving a pin contact;

wherein said flat contact portions of each spring tine are disposed substantially perpendicularly to one another; and wherein each said flat contact portion has an inwardly projecting contact point disposed thereon.

* * * * *